US006692602B1

(12) United States Patent
Mensing et al.

(10) Patent No.: US 6,692,602 B1
(45) Date of Patent: Feb. 17, 2004

(54) MACHINE FOR PRODUCING A CORRUGATED CARDBOARD SHEET AND PROCESS FOR CALIBRATING THE GLUE GAP OF SUCH A MACHINE

(75) Inventors: Hermann-Josef Mensing, Weiherhammer (DE); Reinhard Sternitzke, Kaltenbrunn (DE); Josef Puff, Vohenstrauss (DE)

(73) Assignee: BHS Corrugated Maschinen-und Anlagenbau GmbH, Weiherhammer (DE)

( * ) Notice: Subject to any disclaimer, the term of this patent is extended or adjusted under 35 U.S.C. 154(b) by 340 days.

(21) Appl. No.: 09/667,713

(22) Filed: Sep. 22, 2000

(30) Foreign Application Priority Data

Sep. 22, 1999 (DE) ..... 199 45 388
Jul. 18, 2000 (DE) ..... 100 34 780

(51) Int. Cl.[7] ..... B31F 1/20

(52) U.S. Cl. ..... 156/205; 156/350; 156/462; 156/472

(58) Field of Search ..... 118/212, 211; 425/101; 156/578, 582, 64, 205, 206, 210, 356, 360, 367, 378, 462, 467, 470, 471, 472, 208, 350

(56) References Cited

U.S. PATENT DOCUMENTS 1,961,829 A * 6/1934 Rutoskie et al. ..... 118/667
2,641,220 A * 6/1953 Weber et al. ..... 118/259
2,827,873 A * 3/1958 Thorn
4,319,947 A * 3/1982 Tokuno ..... 156/351
4,549,924 A * 10/1985 Berthelot et al. ..... 156/470
4,629,526 A * 12/1986 Kanda ..... 156/210
4,806,183 A * 2/1989 Williams ..... 118/672
5,336,319 A * 8/1994 Narang et al. ..... 118/211
6,068,701 A * 5/2000 Kohler et al. ..... 118/119
6,409,857 B2 * 6/2002 Pallas et al. ..... 118/258

FOREIGN PATENT DOCUMENTS

EP 870598 A1 * 10/1998 ..... B31F/1/28

* cited by examiner

*Primary Examiner*—Michael W. Ball
*Assistant Examiner*—Gladys Corcoran
(74) *Attorney, Agent, or Firm*—Browdy and Neimark, P.L.L.C.

(57) ABSTRACT

A machine for producing corrugated cardboard incorporates a corrugating roll and a glue roll extending parallel to the former in such a way that a glue gap is formed between the two. To adjust the glue gap, the bearing of the glue roll is pushed against the bearing of the corrugating roll with a contact-pressure force A. By means of an adjusting unit the distance of the two bearings is reduced until the force of the bearing contact pressure, which is measured by a force measuring unit, decreases due to a contact occuring between the glue roll and the corrugating roll. The glue roll may have stop rings at its ends to prevent a direct contact between the glue roll and the corrugating roll.

20 Claims, 3 Drawing Sheets

MACHINE FOR PRODUCING A CORRUGATED CARDBOARD SHEET AND PROCESS FOR CALIBRATING THE GLUE GAP OF SUCH A MACHINE

BACKGROUND OF THE INVENTION

1. Field of the Invention

The present invention relates to a machine for producing a corrugated cardboard sheet and a process for calibrating the glue gap of such a machine.

2. Background Art

From well-known prior use it is known that, to adjust the width of the glue gap between a corrugating roll and a glue roll in a corrugated cardboard machine, an operator manually holds a so-called splicing tape with a predetermined thickness between the corrugating roll, which has a corrugated sheet placed on it, and the glue roll. The distance between the glue roll and the corrugating roll is then reduced. This is done while the corrugating roll is rotating and the glue roll is rotating. The width of the glue gap is reduced until the splicing tape is pulled in by the rotating rolls. The glue gap has then been adjusted to the thickness of the splicing tape. However, this method of adjusting the glue gap has the disadvantage that the adjustment is time-consuming and cannot be done automatically. There furthermore is the danger that the hand in which the operator is holding the splicing tape may be pulled into the glue gap and may be injured.

A machine for producing a corrugated cardboard sheet is known from DE 197 15 174 A1. The glue roll is pushed directly against the corrugated sheet that is wound around a portion of the corrugating roll. There is no glue gap between the corrugated sheet and the outer face of the glue roll. To adjust a predetermined contact pressure between the glue roll and the corrugated sheet, a force-measuring unit is provided, as well as a means for changing the distance between the corrugating roll and the glue roll. The shortcoming of this arrangement is that the glue roll pushes against the corrugating roll with a predetermined force, which may result in damage to the glue roll.

SUMMARY OF THE INVENTION

The present invention, therefore, has as its object to provide a machine for producing corrugated cardboard in which the adjustment of the glue gap can be carried out in the simplest possible manner and automatically.

This object is met with a machine for producing a corrugated cardboard sheet, which incorporates at least one corrugated sheet with corrugation crests and at least one liner sheet that is glued to the corrugation crests, comprising at least one corrugating roll, which serves to give the corrugated sheet its shape, incorporating a corrugating-roll axis around which the corrugating roll can rotate, a first corrugating-roll end with a first corrugating-roll bearing journal, which is mounted in a first corrugating-roll bearing, and a second corrugating-roll end with a second corrugating-roll bearing journal, which is mounted in a second corrugating-roll bearing, a gluing device for applying glue onto the corrugation crests by means of a glue roll incorporating a glue-roll axis, around which the glue roll can rotate, and which extends parallel to the corrugating-roll axis, incorporating a first glue-roll end with a first glue-roll bearing journal mounted in a first glue-roll bearing, which is assigned to the first corrugating-roll bearing, incorporating a second glue-roll end with a second glue-roll bearing journal mounted in a second glue-roll bearing, which is assigned to the second corrugated-roll bearing, delimiting, between itself and the corrugating roll, a glue gap of a width B, and advanceable towards the corrugating roll for adjusting the width B of the glue gap, and a calibration device for adjusting the width B of the glue gap having at least one contact-pressure unit for pressing a glue-roll bearing against the corresponding corrugating-roll bearing with a contact-pressure force A, at least one force-measuring unit for measuring a force of the bearing contact pressure P between the pressed-on glue-roll bearing and the corresponding corrugating-roll bearing, at least one adjusting unit for adjusting a bearing distance L between a pressed-on glue-roll bearing and the corresponding corrugating-roll bearing, and at least one control unit, which is connected to the at least one force-measuring unit and the at least one adjusting unit for the transfer of signals, and which activates the at least one adjusting unit in such a way that at least one bearing distance L is reduced, until the force of the bearing contact pressure P decreases based on the glue roll and the corrugating roll coming into contact with one another.

According to another aspect of the invention, a process for calibrating a machine for producing a corrugated cardboard sheet comprises the following steps, providing a machine for producing a corrugated cardboard sheet, which incorporates at least one corrugated sheet with corrugation crests and at least one liner sheet that is glued to the corrugation crests, comprising at least one corrugating roll, which serves to give the corrugated sheet its shape, incorporating a corrugating-roll axis around which the corrugation roll can rotate, a first corrugating-roll end with a first corrugating-roll bearing journal, which is mounted in a first corrugating-roll bearing, and a second corrugating-roll end with a second corrugating-roll bearing journal, which is mounted in a second corrugating-roll bearing, a gluing device for applying glue onto the corrugation crests by means of a glue roll, incorporating a glue-roll axis, around which the glue roll can rotate and which extends parallel to the corrugating-roll axis, incorporating a first glue-roll end with a first glue-roll bearing journal mounted in a first glue-roll bearing, which is assigned to the first corrugating-roll bearing, incorporating a second glue-roll end with a second glue-roll bearing journal mounted in a second glue-roll bearing, which is assigned to the second corrugated-roll bearing, delimiting, between itself and the corrugating roll, a glue gap of a width B, and advanceable towards the corrugating roll for adjusting the width B of the glue gap, and a calibration device for adjusting the width B of the glue gap having at least one contact-pressure unit for pressing a glue-roll bearing against the corresponding corrugating-roll bearing with a contact-pressure force A, at least one force-measuring unit for measuring a force of the bearing contact pressure P between the pressed-on glue-roll bearing and the corresponding corrugating-roll bearing, and at least one adjusting unit for adjusting a bearing distance L between a pressed-on glue-roll bearing and the corresponding corrugating-roll bearing, positioning of the glue roll in a starting position in which the glue roll is not in contact with the corrugating roll, and reduction of at least one bearing distance L by means of the adjusting unit, until the force of the bearing contact pressure P decreases due to a contact between the glue roll and the corrugating roll.

The gist of the invention entails pushing the bearing of the glue roll against the bearing of the corrugating roll with a predetermined force, and measuring the force of the bearing contact pressure between the two bearings. The distance between both bearings is subsequently reduced until the glue roll comes into contact with the corrugating roll. This is detected because the force of the bearing contact pressure decreases, since a portion of the contact-pressure force is transferred via the rolls.

Further features, advantages and details of the invention will become apparent from the ensuing description of an exemplary embodiment, taken in conjunction with the drawing.

DESCRIPTION OF THE PREFERRED EMBODIMENT

Figure 1:
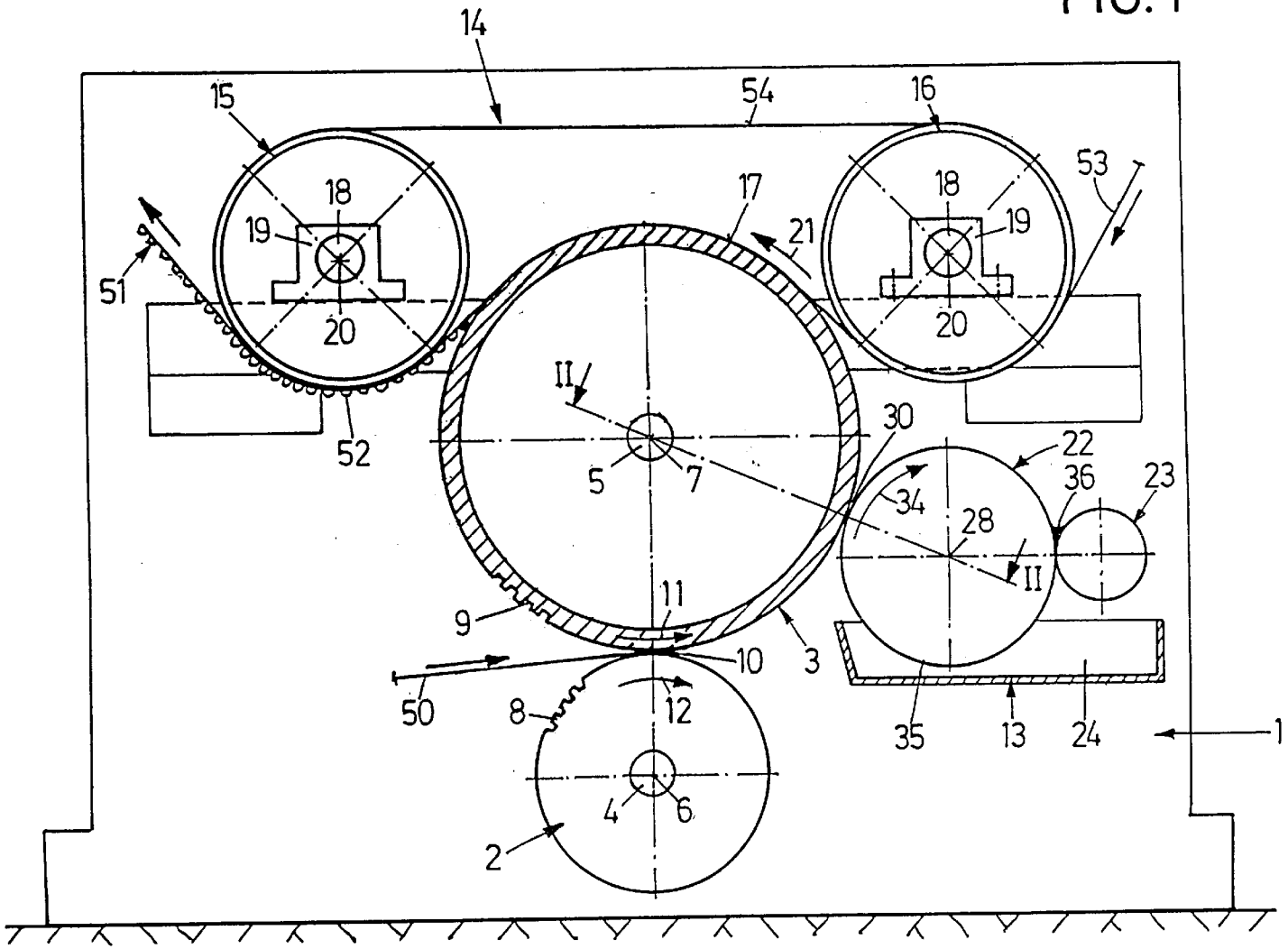
FIG. 1 shows a machine for producing a single-faced corrugated cardboard sheet in a vertical, partially cut open illustration.

A machine for producing corrugated cardboard incorporates a machine stand 1, in which a lower corrugating roll 2 and an upper corrugating roll 3 are rotatably mounted by means of respective shafts 4 and 5. They incorporate axes 6 and 7 that are parallel to one another. On their cylinder surfaces they are provided with ribbings 8 and 9 that extend parallel to the axes 6, 7 and are in meshing engagement with each other in the contact area 10 of the two corrugating rolls 2, 3. One of the corrugating rolls 2,3, generally the upper corrugating roll 3, is driven in one direction of rotation 11, while the other corrugating roll, therefore, generally the lower corrugating roll 2, is moved along in a direction of rotation 12 by the other corrugating roll 3. A gluing device 13 is arranged in the machine stand 1, in the direction of rotation 11 or 12, after the contact area 10. In the upper area of the corrugating roll 3, a contact-pressure device 14 is provided, which incorporates a first deflection roll 15, a second deflection roll 16 and a contact-pressure belt 17. The deflection rolls 15 and 16 each are rotatably mounted around an axis 20 by means of shaft journals 18 in beings 19 of the machine stand 1 and are moved along by the upper corrugating roll 3 via the contact-pressure belt 17, which revolves as indicated by the directional arrow 21.

The gluing device 13 incorporates a glue roll 22, a glue metering roll 23 and a glue container 24. The glue roll 22 incorporates, at its longitudinal ends, journals 25 that are rotatably mounted around an axis 28 in a bearing 27 having a bearing housing 26. The bearing housing 26 is arranged in a wall 29 of the machine stand 1. The axis 28 of the glue roll 22 extends parallel to the axis 7 of the upper corrugating roll 3 in such a way that a glue gap 30 of the width B is formed between the corrugating roll 3 and the glue roll 22. The corrugating roll 3 also has, at its longitudinal ends, bearing journals 31 that are each arranged in a bearing 33 with a bearing housing 32, in such a way that the bearing housing 32 is arranged in the wall 29. The glue roll 22 is driven in the same direction as the corrugating roll 3, in the direction of rotation 34, at nearly the same circumferential speed as the corrugating roll 3.

The glue roll 22 immerses into the glue container 24 with a portion of its outer face 35. Due to its rotation, a glue film is continually applied from the glue bath 24 onto the outer face 35. The glue metering roll 23 is advanceable towards the glue roll 22 and together they delimit an adjustable metering gap 36. The glue roll 22 has at its two ends a stop ring 36*a*, which is formed concentrically to the axis 28 and connected to the glue roll 22. This stop ring 36*a* has an outer diameter $D_A$, which is larger, specifically slightly larger, than the outer diameter $D_L$ of the glue roll 22 in the region between the stop rings 36*a*.

Figure 2:
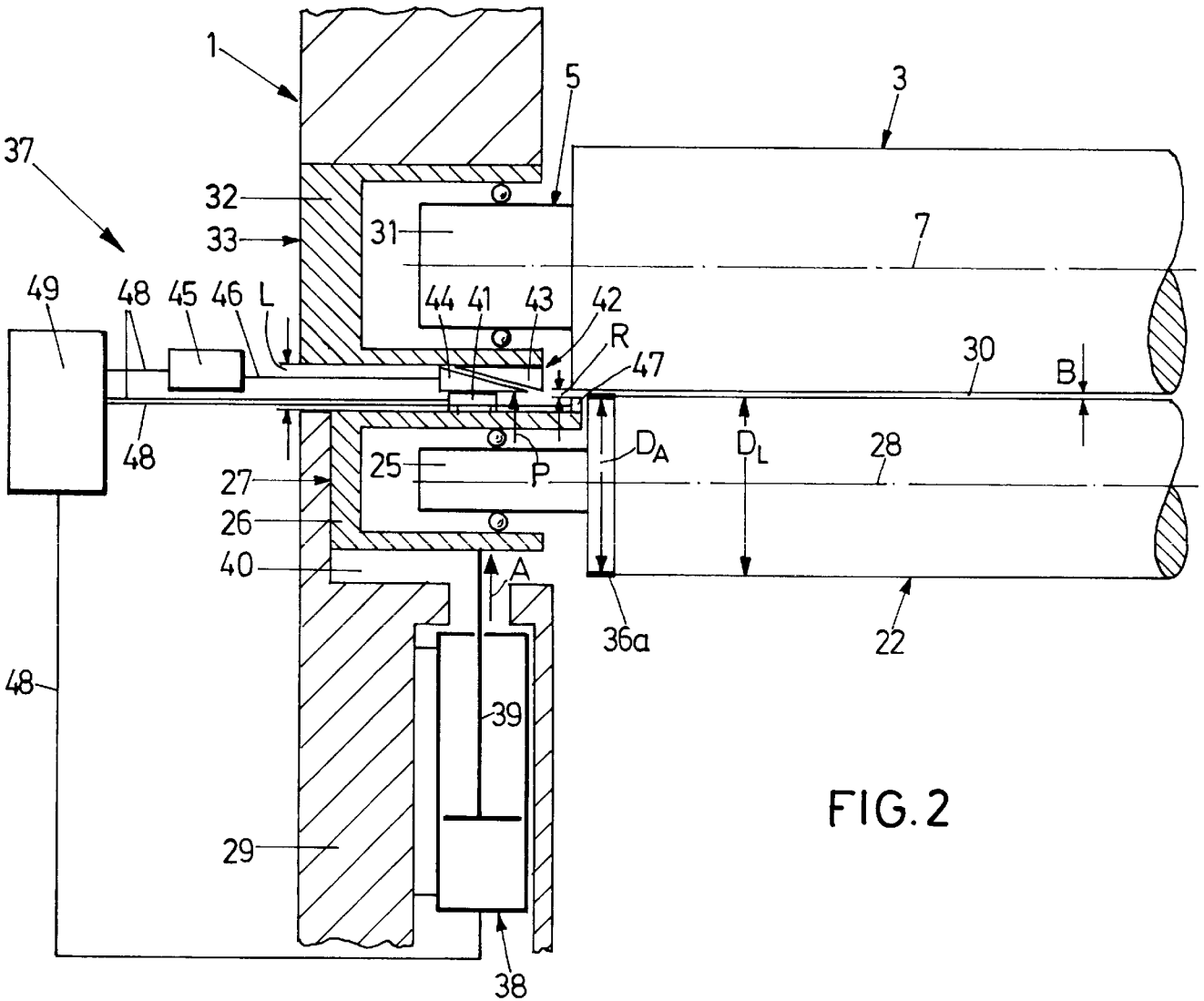
FIG. 2 shows a cross-section through the left half of the machine according to the section line II—II in FIG. 1.
Figure 3:
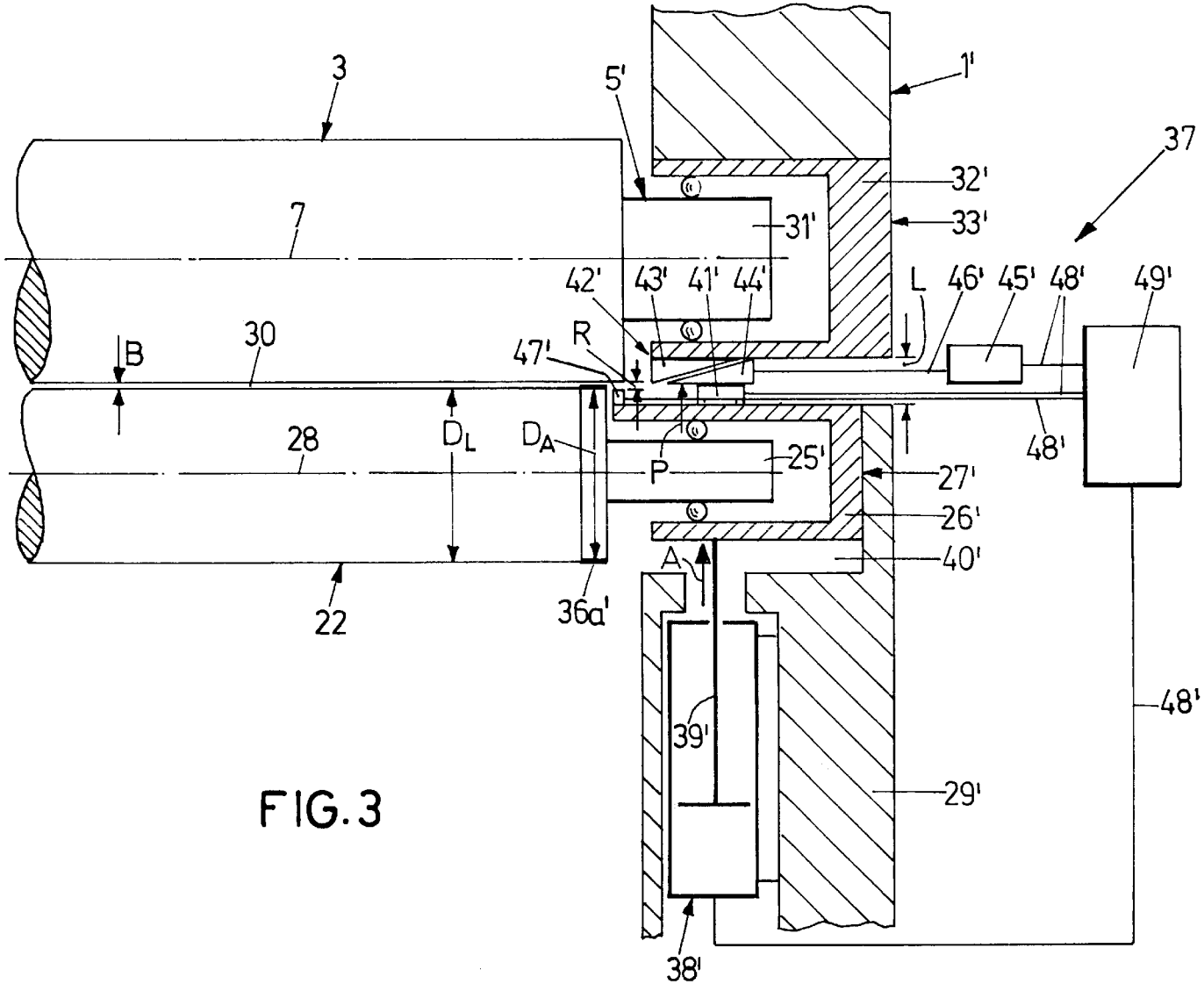
FIG. 3 shows a cross-section through the right half of the machine according to the section line 11—11 in FIG. 1.

To adjust the width B of the glue gap 30, a calibration device 37 is provided. It incorporates, in the region of the two ends of the glue roll 22, a contact-pressure unit 38, which incorporates a piston rod 39 that can be shifted perpendicular to the axis 28 and pushes, with a contact-pressure force A, against the bearing housing 26 that is movably guided inside a sliding guide 40 perpendicular to the axis 28 and in the plane spanned by the axes 7 and 28. Between the bearing housings 26 and 32, a force-measuring unit 41 designed in the form of a load cell and an adjusting unit 42 for adjusting the bearing distance L between the bearing housings 26 and 32 are provided adjacent to one another. The adjusting unit 42 incorporates a wedge 43 that is connected to the bearing housing 32, and a sliding wedge 44 that is movable in a direction parallel to the axis 28 between the force-measuring unit 41 and the wedge 43 by a spindle motor 45 serving as a drive mechanism and as activation means, respectively, via a spindle 46. On the end of the bearing housing 26 that faces the glue roll 22, a commercially available eddy current sensor 47 is provided for measuring its distance R to the corrugating roll 3. The eddy current sensor 47, the force-measuring unit 41, the spindle motor 45, and the contact-pressure unit 38 are connected to a control the 49 by means of control wires 48. FIG. 3 shows the mirror image of FIG. 2, with the corresponding elements receiving the same reference numerals as in FIG. 2, but with a prime mark.

The action of the machine will be described below, first in the normal operation. A paper sheet 50 enters into the contact area 10 and is turned into a corrugated sheet by the ribbings 8, 9. The corrugated sheet 51 has corrugation crests 52 onto which glue is applied in the gluing device 13. No glue is applied to the remaining areas of the corrugated sheet 51. Via the deflection roll 16, a liner sheet 53 is fed in, which is also made of paper and has the same width as the paper sheet 50. The liner sheet 53 is fed in towards the outer side 54 of the contact-pressure belt 17 and, in the region in which the contact-pressure belt 17 rests against the corrugating roll 3, pressed against the corrugation crests 52 and bonded to same. The unit composed of the corrugated sheet 51 and liner sheet 53 is subsequently led around the deflection roll 15.

Following is a description of the calibration of the width B of the glue gap 30. The corrugating roll 3 and the glue roll 22 are initially farther apart from one another by more than the width that is to be adjusted by the calibration. A contact-pressure unit 38 pushes, at one end of the glue roll 22, the bearing housing 26 against the bearing housing 32 with a contact-pressure force A. Neither the glue roll 22 nor the stop ring 36*a* are in contact with the corrugating roll 3. The force of the bearing contact pressure P measured in the force measuring unit 41 essentially corresponds to the contact-pressure force A. The sliding wedge 44 is subsequently moved to the left in FIG. 2 by the spindle motor 45, which reduces the bearing distance L. This is done until the stop ring 36*a* comes into contact with the corrugating roll 3. At this moment the path of the contact-pressure force A branches out, since a portion of the contact-pressure force A is now transferred via the stop ring 36*a* to the corrugating roll and another portion continues to be transferred via the bearing housing 26 and the force measuring unit 41 to the bearing 32. The force of the bearing contact pressure P that is measured in the force-measuring unit 41 thus decreases, resulting in the detection of the contact of the stop ring 36*a* with the corrugating roll 3. The outer diameter $D_A$ of the stop ring 36*a* is selected such that the following is true relative to the remaining outer diameter $D_L$ of the glue roll 22: $(D_A-D_L)/2$ corresponds to the width of the calibrated glue gap 30. The calibration process is performed at both ends of the glue roll 22. With the control unit 49 the calibration process can be performed completely automatically at both ends of the glue roll 22. The stop ring 36*a* that projects relative to the glue roll 22 prevents the glue roll 22 from coming into contact with the corrugating roll 3, which could cause damage to the surface of the glue roll 22. The projection $(D_A-D_L)/2$ of the stop ring 36*a* relative to the glue roll 22 is selected such that it is smaller than the smallest processed thickness of the corrugated sheet 51.

After calibration of the glue gap 30, the glue roll 22 is slightly lifted off the corrugation roll 3, as it was before. The glue gap 30 that has been adjusted in this manner has a known width, which results from the width of the calibrated glue gap 30 and the height by which the glue roll 22 was lifted off. This height can be measured with the eddy current sensor 47. The glue gap 30 is adjusted such that its width corresponds to the thickness of the corrugated sheet 51 plus a predefined amount of slip, which is between 0.01 mm and 0.03 mm, especially 0.02 mm. Changes in the gap width, which may occur, e.g., due to thermal expansion, are measured during the operation by the eddy current sensor 47 and automatically readjusted by the control unit 49 and the adjusting unit 42.

It is possible to not provide stop rings 36*a* on the glue roll 22. In this case the glue roll 22 is advanced directly against the corrugated sheet 51 that is partly wrapped around the corrugating roll 3. This is significant especially with paper sheets 50 of an extremely small thickness, since, in this case, the stop ring 36*a* would have to project relative to the glue roll 22 by a barely measurable amount.

The above approach in particular, in which the glue roll 22 is advanced directly against the corrugated sheet 51 that is partly wrapped around the corrugating roll 3, makes it possible to perform the calibration of the glue roll 22 and its adjustment in one pass, so-to-speak, in a continuous process. For this purpose the glue roll 22 is again slightly lifted off the corrugated sheet 51 after the contact between the glue roll 22 and the corrugated sheet 51, namely by an amount of 0.01 to 0.03 mm, preferably by approximately 0.02 mm.

During the glue application the glue roll is driven with slip relative to the corrugating roll 3 for all applications, and thus relative to the corrugated sheet 51, at a circumferential speed that is between 1 to 10% lower; the glue roll 22 thus moves more slowly than the corrugated sheet 51.

What is claimed is:

1. A machine for producing a corrugated cardboard sheet, which incorporates at least one corrugated sheet (51) with corrugation crests (52) and at least one liner sheet (53) that is glued to the corrugation crests (52), comprising at least one corrugating roll (3), which serves to give the corrugated sheet (51) its shape, incorporating a corrugating-roll axis (7) around which the corrugating roll (3) can rotate, a first corrugating-roll end with a first corrugating-roll bearing journal (31), which is mounted in a first corrugating-roll bearing (33), and a second corrugating-roll end with a second corrugating-roll bearing journal (31'), which is mounted in a second corrugating-roll bearing (33'), a gluing device (13) for applying glue onto the corrugation crests (52) by a glue roll (22)

incorporating a glue-roll axis (28), around which the glue roll (22) can rotate, and which extends parallel to the corrugating-roll axis (7), incorporating a first glue-roll end with a first glue-roll bearing journal (25) mounted in a first glue-roll bearing (27), which corresponds to the first corrugating-roll bearing (33), incorporating a second glue-roll end with a second glue-roll bearing journal (25') mounted in a second glue-roll bearing (27'), which corresponds to the second corrugated-roll bearing (33'), delimiting, between itself and the corrugating roll (3), a glue gap (30) of a width B, and advanceable towards the corrugating roll (3) for adjusting the width B of the glue gap (30), and a calibration device (37) for adjusting the width B of the glue gap (30) having at least one contact-pressure unit (38, 38') for pressing a glue-roll bearing (27, 27') against the corresponding corrugating-roll bearing (33, 33') with a contact-pressure force A, at least one force-measuring unit (41, 41') for measuring a force of a bearing contact pressure P between the pressed-on glue-roll bearing (27, 27') and the corresponding corrugating-roll bearing (33, 33'), at least one adjusting unit (42, 42') for adjusting a bearing distance L between a pressed-on glue-roll bearing (27, 27') and the corresponding corrugating-roll bearing (33, 33'), and at least one control unit (49, 49'), which is connected to the at least one force-measuring unit (41, 41') and the at least one adjusting unit (42, 42') for the transfer of signals, and which activates the at least one adjusting unit (42, 42') in such a way that at least one bearing distance L is reduced, until the force of the bearing contact pressure P decreases based on the glue roll (22) and the corrugating roll (3) coming into contact with one another.

2. A machine as set forth in claim 1, wherein the control unit (49, 49') is connected, for the purpose of transferring signals, to the contact-pressure unit (38, 38').

3. A machine as set forth in claim 1, wherein the calibration device (37) incorporates two contact-pressure units (38, 38').

4. A machine as set forth in claim 1, wherein the calibration device (37) incorporates two force-measuring units (41, 41').

5. A machine as set forth in claim 4, wherein the calibration device (37) incorporates two adjusting units (42, 42').

6. A machine as set forth in claim 5, wherein at least one of the adjusting units (42, 42') incorporates two wedges (43, 44; 43', 44') that are displaceable relative to one another.

7. A machine as set forth in claim 6, wherein one wedge (44, 44') of the at least one adjusting unit (42, 42') is movable by a drive mechanism relative to the other wedge (43, 43'), which is stationary.

8. A machine as set forth in claim 1, wherein the corrugating roll has a corrugated sheet (51) that is at least partly wrapped around the former, and that the at least one adjusting unit (42, 42') comprises activation means (45) activating the adjustment unit (42, 42') to reduce a bearing distance L until the force of the bearing contact pressure P decreases due to the glue roll (22) and the corrugated sheet (51) coming into contact with one another.

9. A machine for producing a corrugated cardboard sheet, which incorporates at least one corrugated sheet (51) with corrugation crests (52) and at least one liner sheet (53) that is glued to the corrugation crests (52), comprising at least one corrugating roll (3), which serves to give the corrugated sheet (51) its shape, incorporating a corrugating-roll axis (7) around which the corrugating roll (3) can rotate, a first corrugating-roll end with a first corrugating-roll bearing journal (31), which is mounted in a first corrugating-roll bearing (33), and a second corrugating-roll end with a second corrugating-roll bearing journal (31'), which is mounted in a second corrugating-roll bearing (33'), a gluing device (13) for applying glue onto the corrugation crests (52) by a glue roll (22)

incorporating a glue-roll axis (28), around which the glue roll (22) can rotate, and which extends parallel to the corrugating-roll axis (7), incorporating a first glue-roll end with a first glue-roll bearing journal (25) mounted in a first glue-roll bearing (27), which corresponds to the first corrugating-roll bearing (33), incorporating a second glue-roll end with a second glue-roll bearing journal (25') mounted in a second glue-roll bearing (27'), which. corresponds to the second corrugated-roll bearing (33'), delimiting, between itself and the corrugating roll (3), a glue gap (30) of a width B, and advanceable towards the corrugating roll (3) for adjusting the width B of the glue gap (30), and a calibration device (37) for adjusting the width B of the glue gap (30) having at least one contact-pressure unit (38, 38') for pressing a glue-roll bearing (27, 27') against the corresponding corrugating-roll bearing (33, 33') with a contact-pressure force A, at least one force-measuring unit (41, 41') for measuring a force of a bearing contact pressure P between the pressed-on glue-roll bearing (27, 27') and the corresponding corrugating-roll bearing (33, 33'), at least one adjusting unit (42, 42')) for adjusting a bearing distance L between a pressed-on glue-roll bearing (27, 27') and the corresponding corrugating-roll bearing (33, 33'), and at least one control unit (49, 49'), which is connected to the at least one force-measuring unit (41, 41') and the at least one adjusting unit (42, 42') for the transfer of signals, and which activates the at least one adjusting unit (42, 42') in such a way that at least one bearing distance L is reduced, until the force of the bearing contact pressure P decreases based on the glue roll (22) and the corrugating roll (3) coming into contact with one another, wherein the glue roll (22) incorporates, on at least one glue-roll end, a stop ring (36*a*, 36*a*') that is arranged concentrically to the glue-roll axis (28) and has an outer diameter $D_A$, that the glue roll (22) has an outer diameter $D_L$, and that the following is true for the outer diameters $D_A$ and $D_L$: $D_A > D_L$.

10. A machine as set forth in claim 9, wherein the control unit (49, 49') is connected, for the purpose of transferring signals, to the contact-pressure unit (38, 38').

11. A machine as set forth in claim 9, wherein the calibration device (37) incorporates two contact-pressure units (38, 38').

12. A machine as set forth in claim 9, wherein the calibration device (37) incorporates two force-measuring units (41, 41').

13. A machine as set forth in claim 9, wherein the calibration device (37) incorporates two adjusting units (42, 42').

14. A machine as set forth in claim 9, wherein one wedge (44, 44') of the at least one adjusting unit (42, 42') is movable by a drive mechanism relative to another wedge (43, 43').

15. A machine as set forth in claim 14, wherein one wedge (44, 44') of the at least one adjusting unit (42, 42') is movable by a drive relative to another stationary wedge (43, 43').

16. A process for calibrating a machine for producing a corrugated cardboard sheet, comprising the following steps:

providing a machine for producing a corrugated cardboard sheet, which incorporates at least one corrugated sheet (51) with corrugation crests (52) and at least one liner sheet (53) that is glued to the corrugation crests (52), comprising at least one corrugating roll (3), which serves to give the corrugated sheet (51) its shape, incorporating a corrugation-roll axis (7) around which the corrugation roll (3) can rotate, a first corrugating-roll end with a first corrugating-roll bearing journal (31), which is mounted in a first corrugating-roll bearing (33), and a second corrugating-roll end with a second corrugating-roll bearing journal (31'), a gluing device (13) for applying glue onto the corrugation crest (52) by a glue roll (22), incorporating a glue-roll axis (28), around which the glue roll (22) can rotate and which extends parallel to the corrugating-roll axis (7), incorporating a first glue-roll end with a first glue-roll bearing journal (25) mounted in a first glue-roll bearing (27), which corresponds to the first corrugating-roll bearing (33), incorporating a second glue-roll end with a second glue-roll bearing journal (25') mounted in a second glue-roll bearing (27'), which corresponds to the second corrugated-roll bearing (33'), delimiting, between itself and the corrugating roll (3), a glue gap (30) of a width B, and advanceable towards the corrugating roll (3) for adjusting the width B of the glue gap (30), and a calibration device (37) for adjusting the width B of the glue gap (30) having at least one contact-pressure unit (38, 38) for pressing a glue-roll bearing (27, 27) against the corresponding corrugating-roll bearing (33, 33) with a contact-pressure force A, at least one force-measuring unit (41, 41) for measuring a bearing contact pressure P between the pressed-on glue-roll bearing (27, 27) and the corresponding corrugating-roll bearing (33, 33), and at least one adjusting unit (42, 42) for adjusting a bearing distance L between a pressed-on glue-roll bearing (27, 27) and the corresponding corrugating-roll bearing (33, 33')

positioning of the glue roll (22) in a staring position in which the glue roll (22) is not in contact with the corrugating roll (3), and reducing at least one bearing distance L by means of the adjusting unit (42), until the force of the bearing contact pressure P decreases due to a contact between the glue roll (22) and the corrugating roll (3).

17. A process for calibrating amachine for producing a corrugated cardboard sheet, comprising the following steps:

providing a machine for producing a corrugated cardboard sheet, with incorporates at least one corrugated sheet (51) with corrugation crests (52) and at least one liner sheet (53) that is glued to the corrugation crests (52), comprising at least one corrugating roll (3), which serves to give the corrugated sheet (51) its shape, incorporating a corrugating-roll axis (7) around which the corrugation roll (3) can rotate, a first corrugating-roll end with a first corrugating-roll bearing journal (31), which is mounted in a first corrugating-roll bearing (33), and a second corrugating-roll end with a second corrugating-roll bearing journal (31'), which is mounted in a second corrugating-roll bearing (33'), a gluing device (13) for applying glue onto the corrugation crests (52) by a glue roll (22), incorporating a glue-roll axis (28), around which the glue roll (22) can rotate and which extends parallel to the corrugating-roll axis (7), incorporating a first glue-roll end with a first glue-roll bearing journal (25) mounted in a first glue-roll bearing (27), which corresponds to the first corrugating-roll bearing (33), incorporating a second glue-roll end with a second glue-roll bearing journal (25') mounted in a second glue-roll bearing (27'), which corresponds to the second corrugated-roll bearing (33'), delimiting, between itself and the corrugating roll (3), a glue gap (30) of a width B, and advanceable towards the corrugating roll (3) for adjusting the width B of the glue gap (30), and a calibration device (37) for adjusting the width B of the glue gap (30) having at least one contact-pressure unit (38, 38) for pressing a glue-roll bearing (27, 27) against the corresponding corrugating-roll bearing (33, 33) with a contact-pressure force A, at least one force-measuring unit (41, 41) for a bearing contact pressure P between the pressed-on glue bearing (27, 27) and the corresponding corrugating-roll bearing (33, 33), and at least one adjusting unit (42, 42) for adjusting a bearing distance L between a pressed-on glue-roll bearing (27, 27) and the corresponding corrugating-roll bearing (33, 33')

positioning of the glue roll (22) in a staring position in which the glue roll (22) is not in contact with the corrugating roll (3), and reducing at least one bearing distance L by means of the adjusting unit (42), until the force of the bearing contact pressure P decreases due to a contact between the glue roll (22) and the corrugating roll (3).

18. A process as set forth in claim 17, wherein the bearing distance L is increased by an amount of 0.01 to 0.03 mm.

19. A process as set forth in claim 17, wherein the corrugating roll (3) and the glue roll (22) are rotationally driven at different circumferential speeds.

20. A process as set forth in claim 19, wherein the glue roll (22) rotates at a circumferential speed that is 1 to 10% slower than that of the corrugating roll (3) with the corrugated sheet (51).

* * * * *